US011067275B2

(12) United States Patent
Pacifico

(10) Patent No.: US 11,067,275 B2
(45) Date of Patent: Jul. 20, 2021

(54) MULTIFUNCTIONAL LIGHTER CASE WITH ADJUSTING CLIP AND POKER

(71) Applicant: Joseph Daniel Pacifico, Rahway, NJ (US)

(72) Inventor: Joseph Daniel Pacifico, Rahway, NJ (US)

( * ) Notice: Subject to any disclaimer, the term of this patent is extended or adjusted under 35 U.S.C. 154(b) by 37 days.

(21) Appl. No.: 16/777,560

(22) Filed: Jan. 30, 2020

(65) Prior Publication Data

US 2020/0191392 A1 Jun. 18, 2020

Related U.S. Application Data

(60) Provisional application No. 62/780,585, filed on Dec. 17, 2018.

(51) Int. Cl.
*F23Q 2/32* (2006.01)
*F23Q 2/36* (2006.01)

(52) U.S. Cl.
CPC ..... *F23Q 2/32* (2013.01); *F23Q 2/36* (2013.01)

(58) Field of Classification Search
CPC ..... A24F 9/04; F23Q 2/32; F23Q 2/36
See application file for complete search history.

(56) References Cited

U.S. PATENT DOCUMENTS 4,600,022 A * 7/1986 Pierce, Jr. ..... A24F 13/26 131/243
4,745,661 A * 5/1988 Wainscott ..... A45C 13/02 150/106
5,829,965 A * 11/1998 Rubalcava ..... F23Q 2/32 431/253
6,341,609 B1 * 1/2002 Morris ..... A24F 13/22 131/187
D648,891 S * 11/2011 Heger ..... D27/161
9,930,912 B2 * 4/2018 Bodenchuk ..... A24F 9/02
2003/0062055 A1 * 4/2003 Park ..... F23Q 2/32 131/249
2008/0248434 A1 * 10/2008 Wein ..... F23Q 2/32 431/253
2010/0065073 A1 * 3/2010 Sweeney ..... A24F 9/04 131/243
2011/0300495 A1 * 12/2011 Viviano ..... A63B 57/207 431/253
2015/0064633 A1 * 3/2015 Dominguez ..... F23Q 2/32 431/253
2016/0290641 A1 * 10/2016 Nix ..... F23Q 2/32
2017/0356651 A1 * 12/2017 Hodge ..... F23Q 2/32

* cited by examiner

*Primary Examiner* — Alfred Basichas
(74) *Attorney, Agent, or Firm* — Walter J. Tencza, Jr.

(57) ABSTRACT

A multi-functional, all inclusive smoking tool may include a housing; a cigarette lighter attached to the housing; a poker attached to the housing so that the poker can swivel outward from the housing and swivel inward towards the housing, while attached to the housing; and wherein the elongated poker is configured to be swiveled outwards from the housing and thereafter used to clean debris from pipes, while attached to the housing. The apparatus may further include a clip attached to the housing so that the clip is configured to be moved, while attached to the housing, from a first position to a second position, with respect to the housing; wherein in the first position, the clip is at least partially within the housing, while attached to the housing; and wherein in the second position, the clip is entirely outside of the housing, while attached to the housing.

15 Claims, 8 Drawing Sheets

LEFT SIDE VIEW

TOP VIEW

FRONT VIEW

BOTTOM VIEW

RIGHT SIDE VIEW

BUDDYCLIP

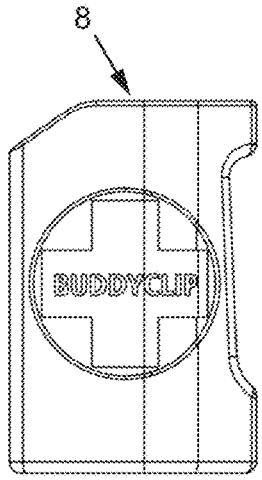
BUDDYCLIP REAR HOUSING
Fig. 9A
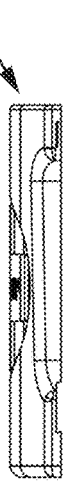
Fig. 9B
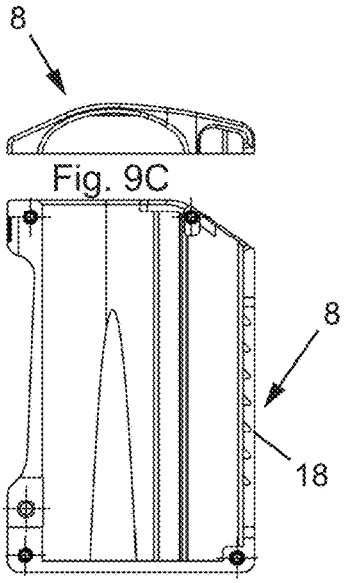
Fig. 9C
Fig. 9D
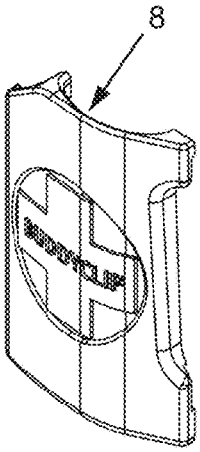
Fig. 9E
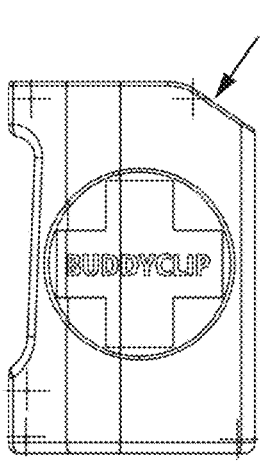
BUDDYCLIP FRONT HOUSING
Fig. 10A
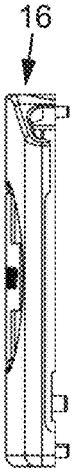
Fig. 10B
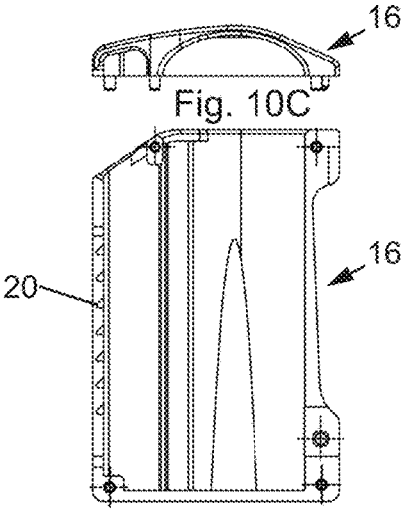
Fig. 10C
Fig. 10D
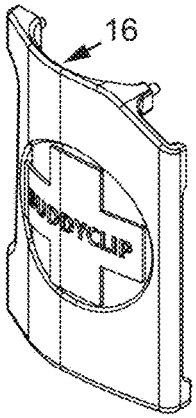
Fig. 10E

12

12a
12

12

12b
12

12

12

BUDDYCLIP ACTUATOR BUTTON
14

14

14

14

BUDDYCLIP BEARING
2

2

2

2

BUDDYCLIP POKER
6
10

6
10

6
10

6
10

BUDDYCLIP ALLIGATOR CLIP
AND ALUMINUM WIRE

MULTIFUNCTIONAL LIGHTER CASE WITH ADJUSTING CLIP AND POKER

CROSS REFERENCE TO RELATED APPLICATION(S)

The present application claims the priority of U.S. provisional patent application Ser. No. 62/780,585, titled "MULTIFUNCTIONAL LIGHTER CASE WITH ADJUSTING CLIP AND POKER", filed on Dec. 17, 2018.

FIELD OF THE INVENTION

This invention relates to smoking tools.

BACKGROUND OF THE INVENTION

Problem Solved

When utilitizing hand rolled cigarettes, one frequently burns his or her self, experiences pipe clogs, or misplaces his/her lighter. These issues are then dealt with by not smoking the hand rolled cigarette to completion, or throwing away the pipe ultimately wasting money.

They do not have a retractable roach clip, which also swivels up and down.

SUMMARY OF THE INVENTION

A multi-functional, all inclusive smoking tool which includes a light holder, pipe cleaner and retractable clip. In at least one embodiment, an apparatus is provided which may be used to hold the tobacco or marijuana cigarette which will help prevent the user's fingers from being burnt.

As stated above, when utilizing hand rolled cigarettes, one frequently burns his or her self, experiences pipe clogs and/or misplaces his/her lighter. These issues are then dealt with by not smoking the Hand rolled cigarette to completion, or throwing away the pipe ultimately wasting money.

The Buddy Clip is a multi-functional smoking tool which contains a metal pick for removing residue from smoking pipes. It also contains a retractable metal clip used to hold rolled cigarettes without burning the user's hands and/or face, all while attached to a lighter holder, which allows for simultaneous lighting of the cigarette while clamped within the metal clip.

The claimed invention differs from what currently exists. Other similar items come in metal and do not have exact combination of tools (lighter holder, retractable metal clip, and metal pick). They do not have the retractable clip which is used to hold the rolled cigarette.

This invention is an improvement on what currently exists.

In at least one embodiment of the present invention, an apparatus is provided which includes a housing; a cigarette lighter attached to the housing; a poker attached to the housing so that the poker can swivel outward from the housing and swivel inward towards the housing, while attached to the housing; and wherein the poker is configured to be swiveled outwards from the housing and thereafter used to clean debris from pipes, while attached to the housing.

The apparatus may further include a clip attached to the housing so that the clip is configured to be moved, while attached to the housing, from a first position to a second position, with respect to the housing; wherein in the first position, the clip is at least partially within the housing, while attached to the housing; and wherein in the second position, the clip is entirely outside of the housing, while attached to the housing.

The apparatus may further include an actuation button attached to the housing so that the button is configured to be moved, while attached to the housing, from a third position to a fourth position, with respect to the housing; and wherein movement of the actuation button, from the third position to the fourth position causes movement of the clip from the first position to the second position, with respect to the housing.

In at least one embodiment, the actuation button projects outwards from a side of the housing when the actuation button is in the third position and when the actuation button is in the fourth position; and wherein the clip projects outwards from a top of the housing when the clip is in the first position.

In at least one embodiment, the clip is attached to a wire, which is attached to a bearing; wherein the actuation button is attached to the bearing; wherein when the actuation button moves, the bearing moves, the wire moves, and the clip moves, with respect to the housing; wherein when the clip is in the first position with respect to the housing, the wire and the bearing are both entirely within the housing; and wherein when the clip is in the second position with respect to the housing, the wire is at least partially outside of the housing, and the bearing is entirely within the housing.

The housing may include a front housing and a rear housing; and wherein the front housing and the rear housing connect together to hold the poker.

In at least one embodiment, a peg of the front housing goes through a looped end of the poker, and then peg is locked into a hole of the rear housing in order to hold the poker in a manner which allows the poker to swivel with respect to the housing.

The clip may be attached to the housing so that the clip is configured to be moved, while attached to the housing, from a first position to a second position, with respect to the housing; wherein in the second position, the clip is configured to hold a cigarette so that the cigarette is lit by the cigarette lighter.

In at least one embodiment of the application an apparatus is provided which includes a housing; a cigarette lighter attached to the housing; a clip attached to the housing so that the clip is configured to be moved, while attached to the housing, from a first position to a second position, with respect to the housing; and wherein in the second position, the clip is configured to hold a cigarette so that the cigarette is lit by the cigarette lighter.

The apparatus may further include an actuation button attached to the housing so that the button is configured to be moved, while attached to the housing, from a third position to a fourth position, with respect to the housing; wherein movement of the actuation button, from the third position to the fourth position causes movement of the clip from the first position to the second position, with respect to the housing; and wherein the actuation button includes at least one protrusion configured to interact with a first plurality of grooves in the housing to hold the clip at the second position with respect to the housing against the force of gravity.

In at least one embodiment, a method is provided which includes swiveling a poker outward from a housing, while the poker is attached to the housing; cleaning debris from one or more pipes, after the poker has been swiveled outwards from the housing, and while the poker is attached to the housing; and swiveling a poker inward toward a housing, while the poker is attached to the housing; and wherein a cigarette lighter is attached to the housing.

A clip and/or an actuation button may be attached to the housing as previously described.

A method, in at least one embodiment, is provided which may include moving a clip from a first position to a second position, while the clip is attached to a housing, wherein a cigarette lighter is attached to the housing wherein in the second position, the clip is configured to hold a cigarette so that the cigarette is configured to be lit by the cigarette lighter; and lighting the cigarette with the cigarette lighter, while the cigarette is being held by the clip, and while the clip is attached to the housing.

In at least one embodiment, an actuation button is attached to the housing so that the actuation button is configured to be moved, while attached to the housing, from a third position to a fourth position, with respect to the housing; wherein movement of the actuation button, from the third position to the fourth position causes movement of the clip from the first position to the second position, with respect to the housing; and wherein the actuation button includes at least one protrusion configured to interact with a first plurality of grooves in the housing to hold the clip at the second position with respect to the housing against the force of gravity.

BRIEF DESCRIPTION OF THE DRAWINGS

FIG. 9A is an outside view of a rear housing of the apparatus of FIG. 1;

FIG. 9B is a left side view of the rear housing of FIG. 9A;

FIG. 9C is a bottom view of the rear housing of FIG. 9A;

FIG. 9D is an inner view of the rear housing of FIG. 9A;

FIG. 9E is an outside, left side, and top perspective view of the rear housing of FIG. 9A;

FIG. 10A is an outside view of a front housing of the apparatus of FIG. 1;

FIG. 10B is a right side view of the front housing of FIG. 10A;

FIG. 100 is a bottom view of the front housing of FIG. 10A;

FIG. 10D is an inner view of the front housing of FIG. 10A;

FIG. 10E is an outside, right side, and top perspective view of the front housing of FIG. 10A;

DETAILED DESCRIPTION OF THE DRAWINGS

Figure 1:
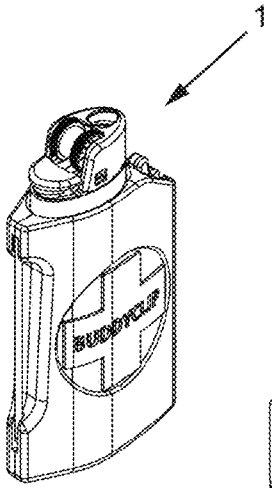
FIG. 1 is a front, top, and left side view of an apparatus, also called the "BUDDYCLIP", in accordance with an embodiment of the present invention, with the apparatus of FIG. 1 shown in a first state.
Figure 2:
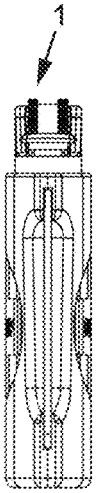
FIG. 2 is a left side view of the apparatus of FIG. 1, with the apparatus of FIG. 1 shown in the first state.
Figure 3:
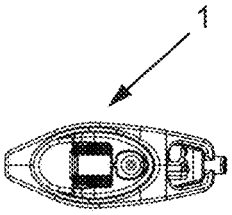
FIG. 3 is a top view of the apparatus of FIG. 1, with the apparatus of FIG. 1 shown in the first state.

FIG. 1 is a front, top, and left side view of an apparatus 1, also called the "BUDDYCLIP", in accordance with an embodiment of the present invention, with the apparatus 1 of FIG. 1 shown in a first state. FIG. 2 is a left side view of the apparatus 1 of FIG. 1, with the apparatus 1 of FIG. 1 shown in the first state. FIG. 3 is a top view of the apparatus 1 of FIG. 1, with the apparatus 1 of FIG. 1 shown in the first state.

Figure 4:
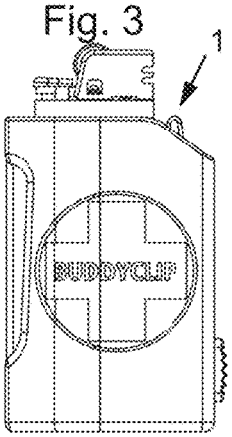
FIG. 4 is a front view of the apparatus of FIG. 1, with the apparatus of FIG. 1 shown in the first state.
Figure 5:
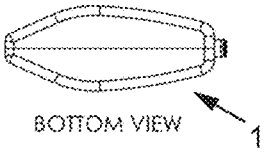
FIG. 5 is bottom view of the apparatus of FIG. 1, with the apparatus of FIG. 1 shown in the first state.
Figure 6:
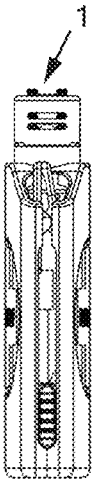
FIG. 6 is a right side view of the apparatus of FIG. 1, with the apparatus of FIG. 1 shown in the first state.
Figure 7:
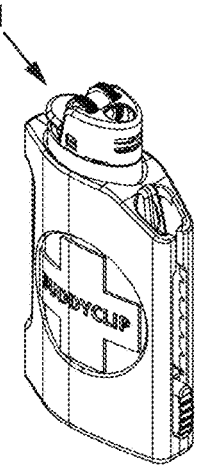
FIG. 7 is a front, top, and right side view of the apparatus of FIG. 1, with the apparatus of FIG. 1 shown in the first state.
Figure 8:
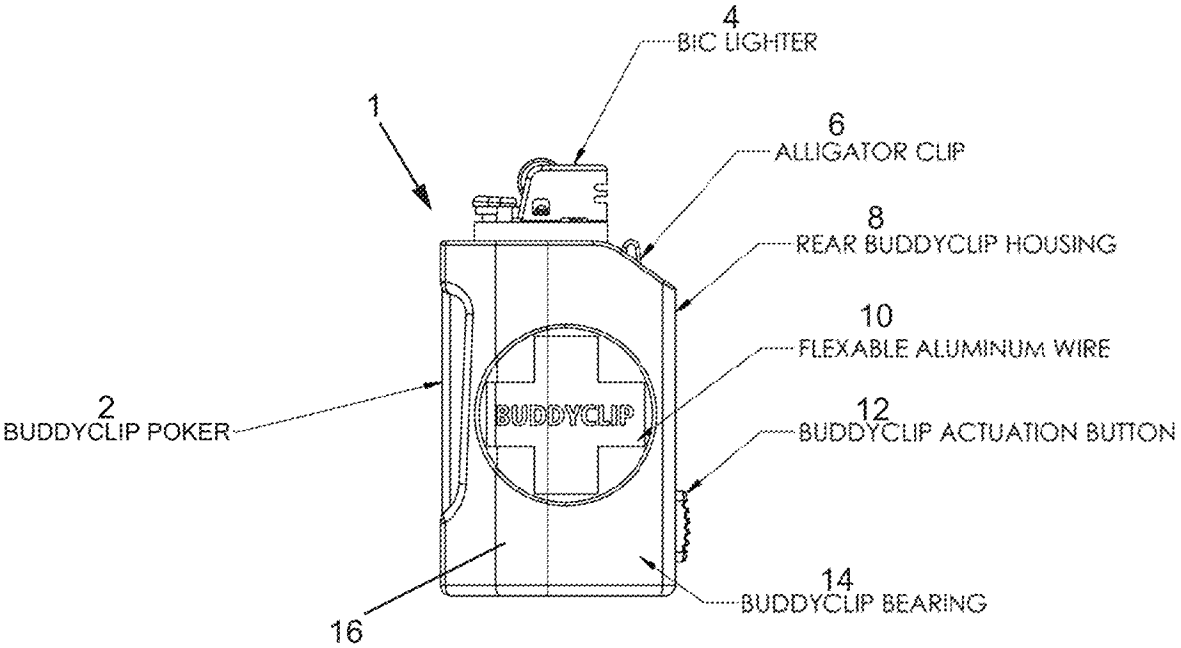
FIG. 8 is front view of the apparatus of FIG. 1, with the apparatus of FIG. 1 shown in the first state.

FIG. 4 is a front view of the apparatus 1 of FIG. 1, with the apparatus of FIG. 1 shown in the first state. FIG. 5 is bottom view of the apparatus 1 of FIG. 1, with the apparatus of FIG. 1 shown in the first state. FIG. 6 is a right side view of the apparatus 1 of FIG. 1, with the apparatus 1 of FIG. 1 shown in the first state. FIG. 7 is a front, top, and right side view of the apparatus 1 of FIG. 1, with the apparatus 1 of FIG. 1 shown in the first state. FIG. 8 is front view of the apparatus 1 of FIG. 1, with the apparatus 1 of FIG. 1 shown in the first state.

The apparatus 1 is also called the "BUDDYCLIP". Referring to FIGS. 1-8, the apparatus 1 includes a poker 2, a lighter 4, such as a BIC (trademarked) cigarette lighter, an alligator clip 6, a rear housing 8, a flexible aluminum wire 10, an actuation button 12, a bearing 14, and a front housing 16.

Figures 11A, 11B, 11C, 11D, 11E, 11F, 12A, 12B, 12C, 12D, 13A, 13B, 13C, 13D, 14A, 14B, 14C, 14D:
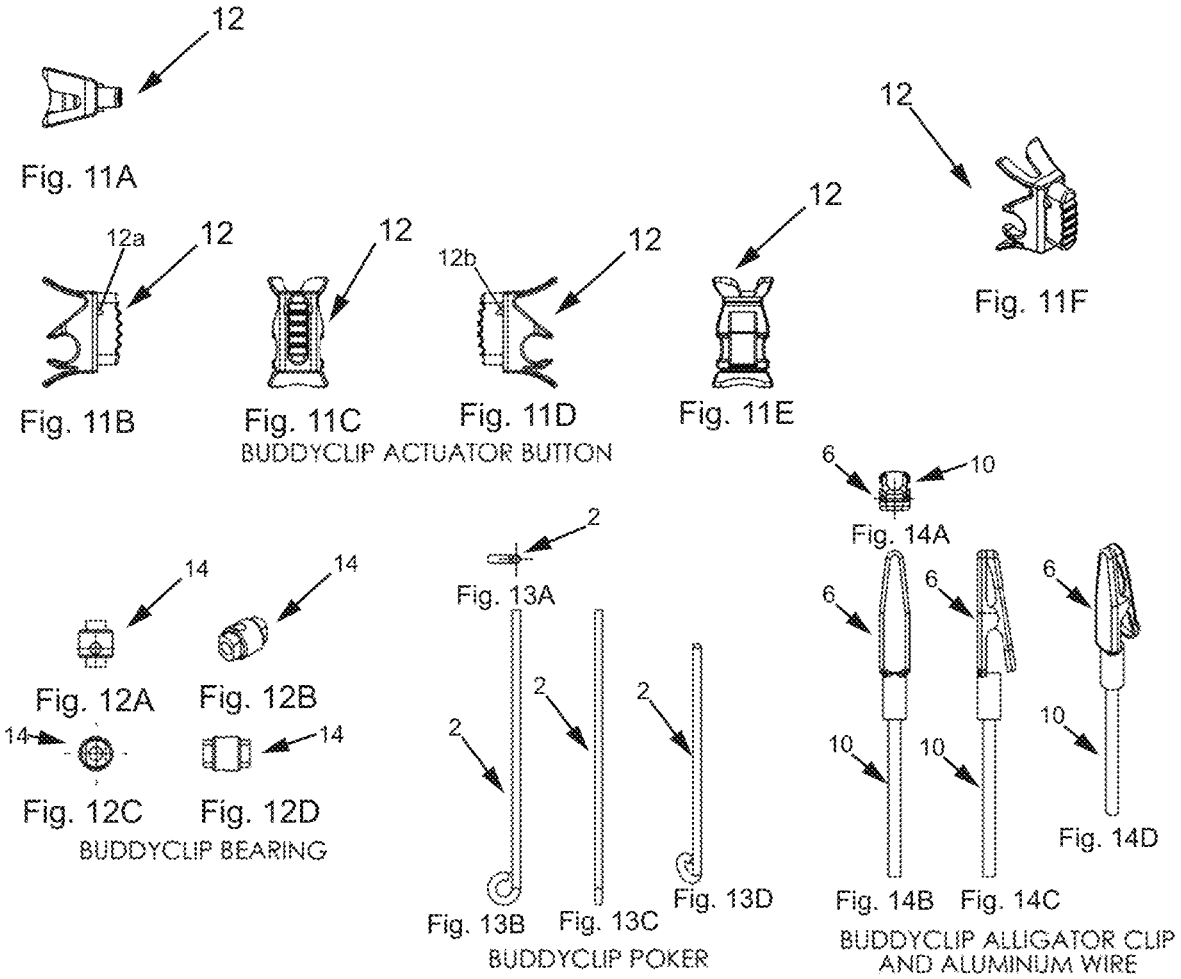
FIG. 11A is a top view of an actuator button of the apparatus of FIG. 1.
FIG. 11B is a front view of the actuator button of FIG. 11A.
FIG. 11C is a right side view of the actuator button of FIG. 11A.
FIG. 11D is a rear view of the actuator button of FIG. 11A.
FIG. 11E is a left side view of the actuator button of FIG. 11A.
FIG. 11F is a top, right side, and front perspective view of the actuator button of FIG. 11A.
FIG. 12A is a top view of a bearing of the apparatus of FIG. 1, along with a vertical and a horizontal line, whose intersection shows the location of an opening.
FIG. 12B is a front, left side, and top perspective view of the bearing of FIG. 12A.
FIG. 12C is a front view of the bearing of FIG. 12A.
FIG. 12D is a side view of the bearing of FIG. 12A.
FIG. 13A is a top view of a poker of the apparatus of FIG. 1, along with a vertical and a horizontal line, whose intersection shows the center of a diameter of an elongated member of the poker.
FIG. 13B is a rear view of the poker of FIG. 13A.
FIG. 13C is a left side view of the poker of FIG. 13A.
FIG. 13D is a rear, top, and left side view of the poker of FIG. 13A.
FIG. 14A is a top view of an alligator clip and aluminum wire of the apparatus of FIG. 1, along with a vertical and a horizontal line which intersect.
FIG. 14B is a front view of the alligator clip and aluminum wire of FIG. 14A.
FIG. 14C is a side view of the alligator clip and aluminum wire of FIG. 14A.
FIG. 14D is a right side, top, and front view of the alligator clip and aluminum wire of FIG. 14A.

In addition, the rear housing 8 may include a plurality of recesses, indentations or grooves 18 shown in FIG. 9D, which are configured to interact with a protrusion 12*b*, shown in FIG. 11D of the actuator button 12; and the front housing 16 includes a plurality or recesses, indentations or grooves 20 shown in FIG. 10D which are configured to interact with the protrusion 12*a*, shown in FIG. 11B, to provide a mechanism for stepping the actuator button 12 upwards on the housing (combination of 16 and 8), while holding the actuator button 12 in one of a plurality of positions against the force of gravity. This allows, in at least one embodiment, a user to fix the height of the button 12 with respect to the housing (combination of 8 and 16) without the button 12 falling back down, have the clip 6 hold a cigarette, and then use one's finger to light the cigarette held by clip 6, using cigarette lighter 4.

FIG. 9A is a outside view of a rear housing 8 of the apparatus 1 of FIG. 1. FIG. 9B is a left side view of the rear housing 8 of FIG. 9A. FIG. 9C is a bottom view of the rear housing 8 of FIG. 9A. FIG. 9D is an inner view of the rear housing 8 of FIG. 9A. FIG. 9E is an outside, left side, and top perspective view of the rear housing 8 of FIG. 9A.

FIG. 10A is a outside view of a front housing 16 of the apparatus 1 of FIG. 1. FIG. 10B is a right side view of the front housing 16 of FIG. 10A. FIG. 100 is a bottom view of the front housing 16 of FIG. 10A. FIG. 10D is an inner view of the front housing 16 of FIG. 10A. FIG. 10E is an outside, right side, and top perspective view of the front housing 16 of FIG. 10A.

FIG. 11A is a top view of an actuator button 12 of the apparatus 1 of FIG. 1. FIG. 11B is a front view of the actuator button 12 of FIG. 11A. FIG. 11C is a right side view of the actuator button 12 of FIG. 11A. FIG. 11D is a rear view of the actuator button 12 of FIG. 11A. FIG. 11E is a left side view of the actuator button 12 of FIG. 11A. FIG. 11F is a top, right side, and front perspective view of the actuator button 12 of FIG. 11A.

Figure 15:
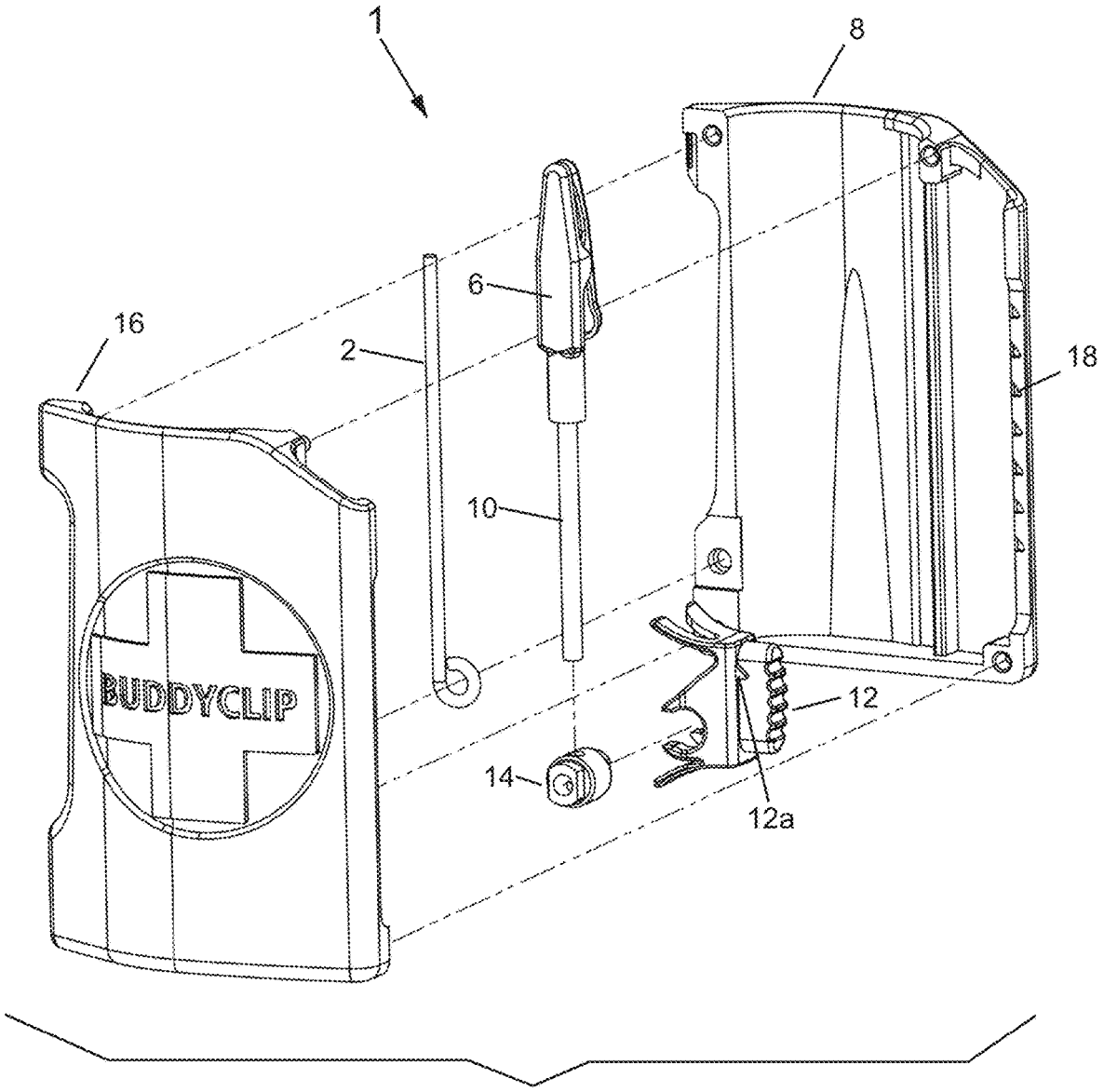
FIG. 15 is an exploded or disassembled view of the apparatus of FIG. 1.

FIG. 12A is a top view of a bearing 14 of the apparatus 1 of FIG. 1, along with a vertical and a horizontal line, whose intersection shows the location of an opening. The bearing 14 is located between the housing 8 and the housing 16 as shown by FIG. 15. FIG. 12B is a front, left side, and top perspective view of the bearing 14 of FIG. 12A. FIG. 12C is a front view of the bearing 14 of FIG. 12A. FIG. 12D is a side view of the bearing 14 of FIG. 12A.

FIG. 13A is a top view of a poker 2 of the apparatus of FIG. 1, along with a vertical and a horizontal line, whose intersection shows the center of a diameter of an elongated member of the poker 2. FIG. 13B is a rear view of the poker 2 of FIG. 13A. FIG. 13C is a left side view of the poker 2 of FIG. 13A. FIG. 13D is a rear, top, and left side view of the poker 2 of FIG. 13A.

FIG. 14A is a top view of an alligator clip 6 and aluminum wire 10 of the apparatus of FIG. 1, along with a vertical and a horizontal line which intersect. FIG. 14B is a front view of the alligator clip 6 and aluminum wire 10 of FIG. 14A. FIG. 14C is a side view of the alligator clip 6 and aluminum wire 10 of FIG. 14A. FIG. 14D is a right side, top, and front view of the alligator clip 6 and aluminum wire 10 of FIG. 14A.

FIG. 15 is an exploded or disassembled view of the apparatus 1 of FIG. 1. The components 2, 6, 8, 10, 12, 14, and 16 are identified in FIG. 15. The grooves, indentations, or recesses 18 are also identified as is the protrusion 12*a* which is part of button 12.

Figure 16:
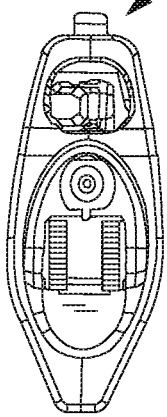
FIG. 16 is a top view of another apparatus, which may be identical to the apparatus of FIG. 1, except for a difference of appearance on the outsides of front and rear housings.

FIG. 16 is a top view of another apparatus, apparatus 100, which may be identical and/or substantially similar to the apparatus 1 of FIG. 1, except for a minor difference of appearance on the outsides of front and rear housings of the apparatus 1 and apparatus 100 as shown by comparison of FIGS. 17, 18, and FIGS. 1 and 7.

Figure 17:
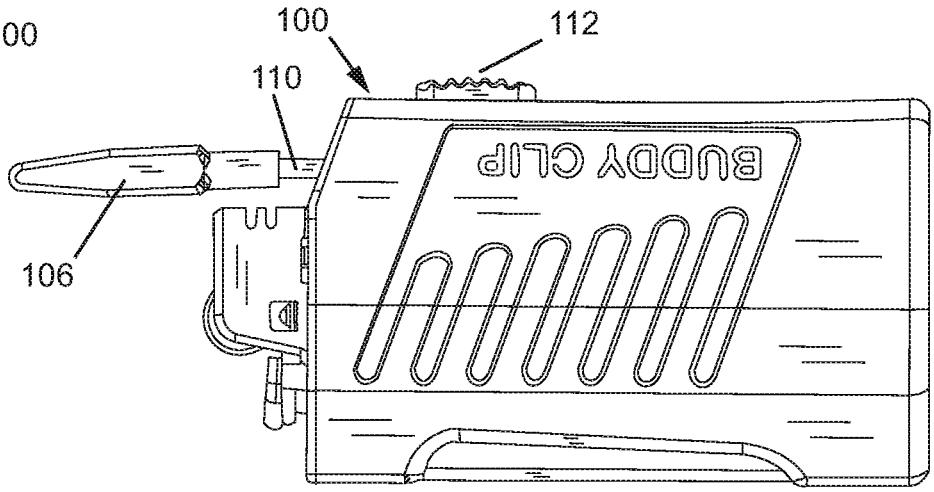
FIG. 17 is a front view of the apparatus of FIG. 16, with the apparatus of FIG. 16 shown in a second state.

FIG. 17 is a front view of the apparatus 100 of FIG. 16, with the apparatus of FIG. 16 shown in a second state, in which an alligator clip 106 and an aluminum wire 110, which may be identical in structure and operation to the clip 6 and the wire 10, are shown in the second state such that clip 106 is outside of a housing of the apparatus 100 and the wire 110 is partially protruding from the housing of the apparatus 100. In the second state, the button 112, which is typically identical to the button 12 of apparatus 1, has been moved to the left in FIG. 17, which would normally be upward, against gravity in typical use, to cause the clip 106 to move outside of the housing of apparatus 100 and to cause the wire 110 to partially protrude outward from the housing of apparatus 100.

Figure 18:
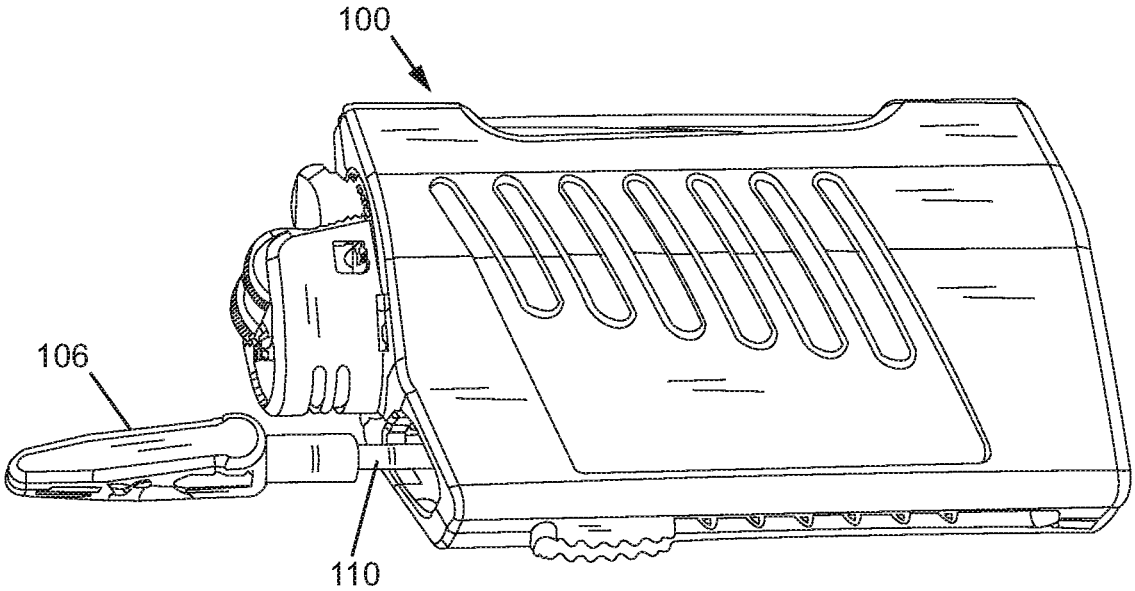
FIG. 18 is a rear, top, and right side perspective view of the apparatus of FIG. 16, with the apparatus of FIG. 16 shown in the second state.

FIG. 18 is a rear, top, and right side perspective view of the apparatus 100 of FIG. 16, with the apparatus 100 of FIG. 16 shown in the second state.

Figure 19:
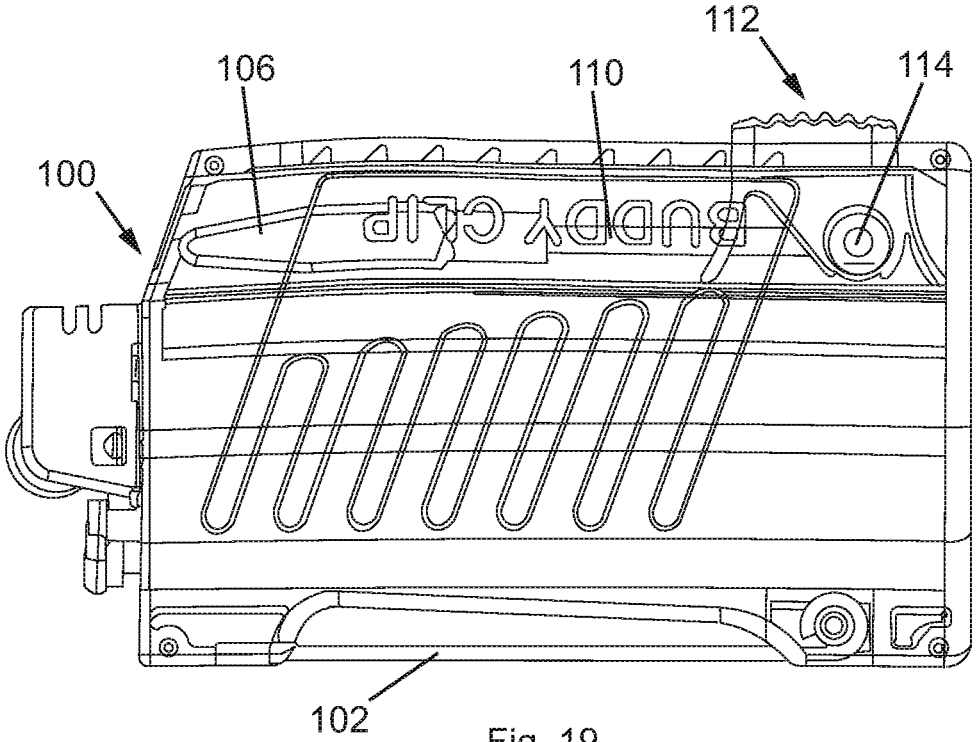
FIG. 19 is a front view of the apparatus of FIG. 16, wherein a front housing is transparent so that various components within an overall housing can be seen, with the apparatus of FIG. 16 shown in the first state.

FIG. 19 is a front view of the apparatus 100 of FIG. 16, with a front housing transparent, and with the apparatus 100 of FIG. 16 shown in the first state, in which most, if not all, of the clip 106 and the wire 110 are inside of the housing of the apparatus 100, and the button 112 has been moved down compared to the position shown in FIGS. 17 and 18, to cause the clip 106 and wire 110 to be fully in the housing of the apparatus 100. In FIG. 19, the front housing, similar or identical to front housing 16 of apparatus 1 is transparent, so that clip 106, wire 110, button 112, and bearing 114 can be seen in FIG. 19.

Figure 20:
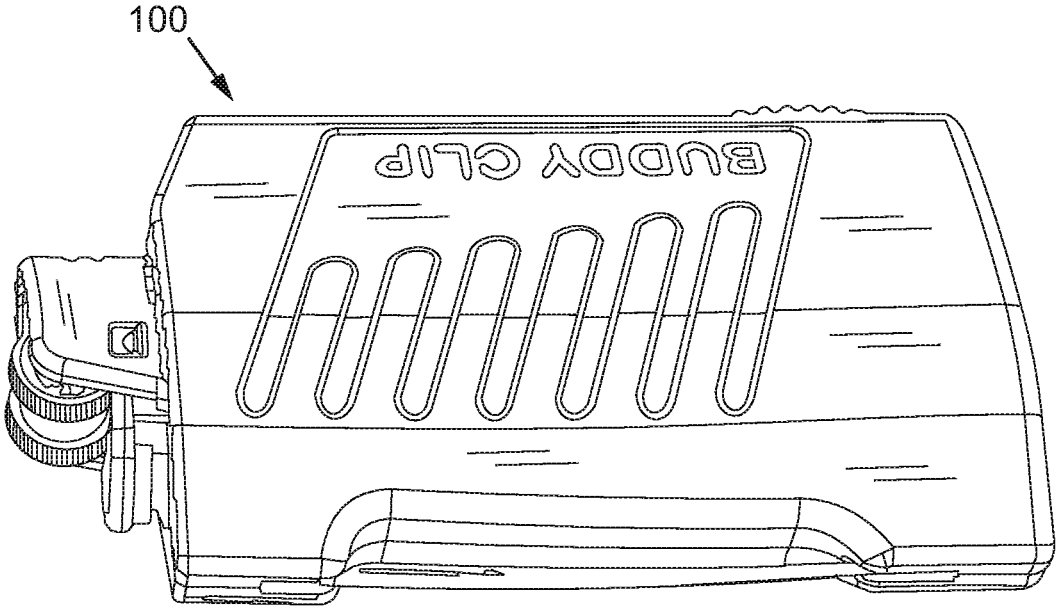
FIG. 20 is a front, top, and left side perspective view of the apparatus of FIG. 16, with the apparatus of FIG. 16 shown in the first state.

FIG. 20 is a front, top, and left side perspective view of the apparatus 100 of FIG. 16, with the apparatus 100 of FIG. 16 shown in the first state.

Figure 21:
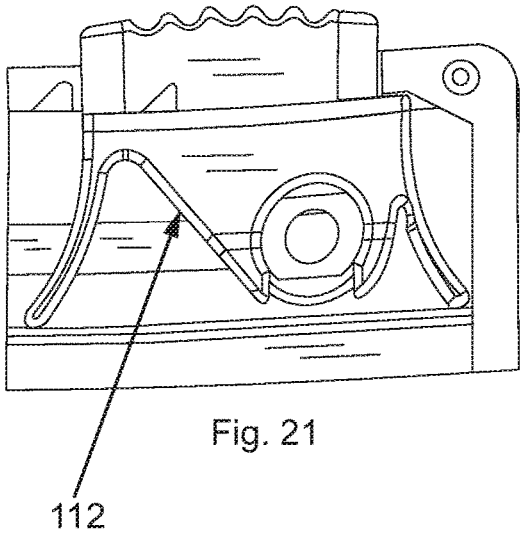
FIG. 21 shows a closeup of an actuation button and various other components of the apparatus of FIG. 16, in the first state.

FIG. 21 shows a closeup view of the actuation button 112 and various other components of the apparatus 100 of FIG. 16, in the first state, wherein the button 112 is at its lowest position, and the clip 106 and wire 110 are within the housing of the apparatus 100.

Figure 22:
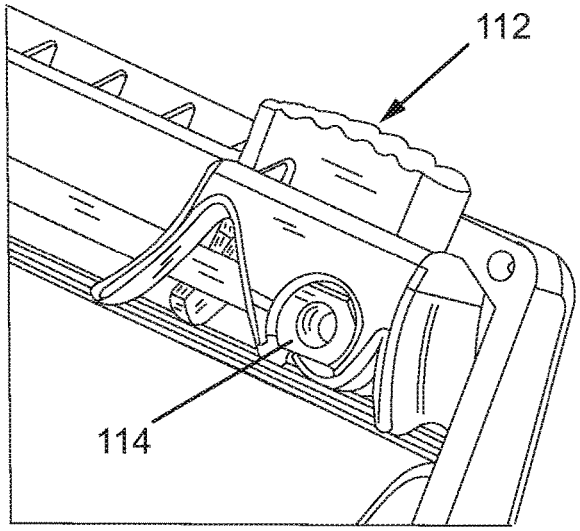
FIG. 22 shows a closeup of the actuation button and various other components of the apparatus of FIG. 16, in the first state.

FIG. 22 shows a closeup view of the actuation button 112, bearing 114, and various other components of the apparatus 100 of FIG. 16, in the first state.

Figure 23:
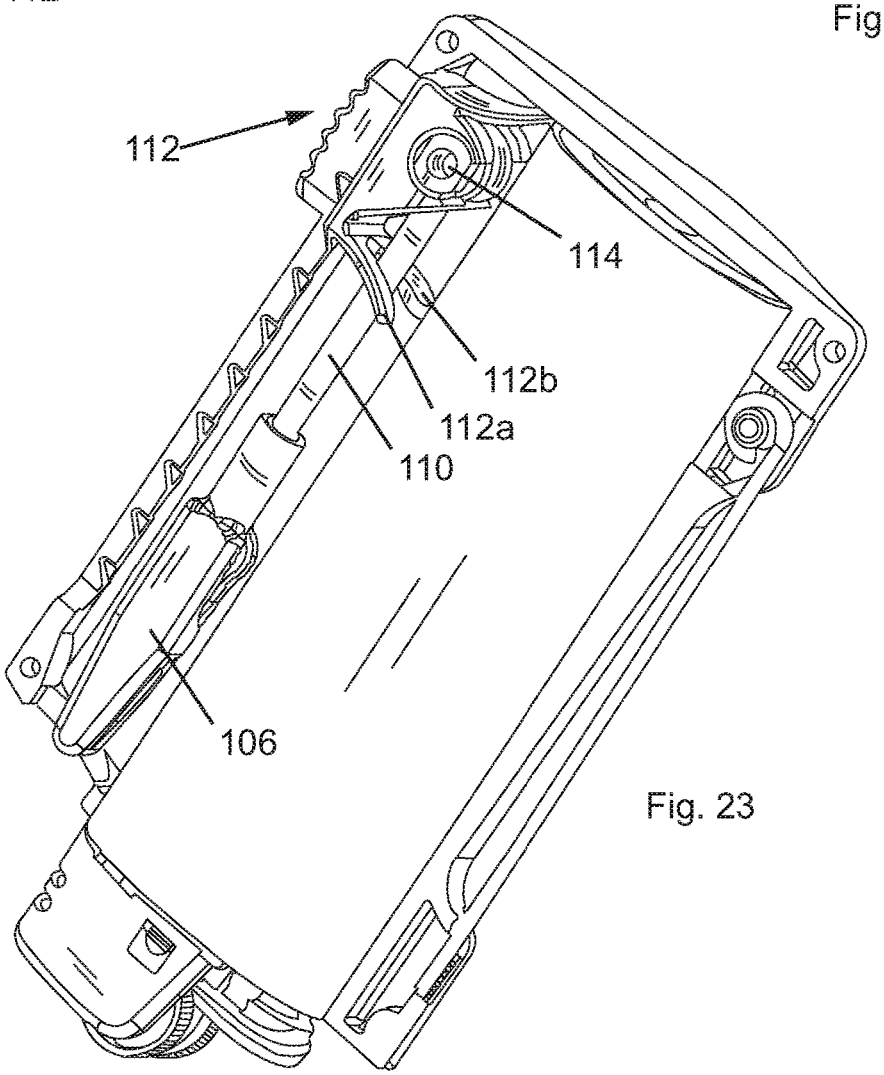
FIG. 23 shows the actuation button, an alligator clip and aluminum wire, and various other components of the apparatus of FIG. 16 in the first state.

FIG. 23 shows the actuation button 112, the alligator clip 106, the aluminum wire 110, bearing 114, and various other components of the apparatus 100 of FIG. 16 in the first state. In addition, legs 112*a* and 112*b* of the button 112 are identified in FIG. 23. The wire 110 passes between the legs

112*a* and 112*b* of the button 112. One end of the wire 110 is fixed to an end of the clip 106 and the opposing end is fixed to the button 112.

The present application incorporates by reference the entirety of U.S. provisional patent application Ser. No. 62/780,585, titled "MULTIFUNCTIONAL LIGHTER CASE WITH ADJUSTING CLIP AND POKER", filed on Dec. 17, 2018.

At least one embodiment of the present Invention discussed here includes:

(a) Buddyclip front housing 16—front half of shell made of plastic. Lock in into BuddyClip rear housing 8.

(b) Buddyclip Rear housing 8—BuddyClip Front Housing 16—rear half of shell made of plastic. Lock in into Buddy Clip Rear housing 8.

(c) Buddyclip Actuator Button 12—made out of high grade plastic.

(d) Buddyclip Poker 2—may be stainless steel pick, 301 stainless steel 0.06 inches, wire depth, 2.049 inches length flat on one side, looped on the other.

(e) Buddy Clip Bearing 14—plastic bearing within the activator button, which holds the aluminum wire and alligator clip.

(f) Buddy Clip Alligator Clip 6 and Aluminum Wire 10—wire length 1.5", 2.4" overall with alligator clip 6 attached. Alligator clip 6 with micro jaw, banana jack/crimp/solder connection. 4 mm connection size with 3/16" jaw opening and toothed style. Length of alligator clip is 1¼" with steel rivet and spring.

Relationship between the components:

In at least one embodiment, first the open side of BuddyClip Alligator Clip 6 and Aluminum Wire 10 is threaded into BuddyClip Bearing 14 and set in place using epoxy glue. The conjoined piece is then snapped into the BuddyClip Actuator Button 12 and set into actuator cut out. At this time, BuddyClip Front Housing 16 (containing five pegs) (1) and Buddy Clip Rear Housing 8 (containing five holes) (2) are connected and locked into place. At the same time the front 16 and rear housing 8 are joined together, the joined actuator 12, aluminum wire 10 and bearing 14 are set inside of the space within front housing 16 with the alligator clip 6 is facing upwards. At the same time, the bottom peg of the front housing 16 goes through the looped end of the BuddyClip Poker 2 and locked into the hole in the Buddy Clip rear housing 8.

How the Invention Works, in at least one embodiment:

The BuddyClip Alligator Clip 6 and Aluminum Wire 10 is threaded into Buddy Clip Bearing 14 and set in place using epoxy glue. The Alligator Clip 6, which is snapped into the BuddyClip Actuator Button 12, can be maneuvered/slid up and down, making it expendable for use and retractable for safety and to be concealed when not in use. The Alligator Clip 6 opens at rivet to allow cigarettes to be held. When connected together, the BuddyClip Front Housing 16 and BuddyClip Rear Housing 8 have space for a lighter to be secured inside. The bottom peg of the front housing 16 goes through the looped end of the BuddyClip Poker 2 and locked into the hole of the BuddyClip rear housing 8. The allows for the BuddyClip Poker 2 to swivel in an outward direction for use of cleaning pipes and an inward direction when not in use for safety and to secure pick safely within the Buddy Clip or apparatus 1 or 100.

How to Make the Invention, in at least one embodiment:

Assemble the Buddy Clip or apparatus 1 or apparatus 100 as described above, snapped into place and secured with epoxy glue. A standard lighter, not included, is to be inserted into the space between the front 16 and rear housing 8 by the user.

In at least one embodiment, at least the components 2, 4, 6, 8, 10, 12, 14, and 16 shown for apparatus 1 by referring to FIGS. 1-15, are considered critical for operation.

How to Use the apparatus 1 or 100, in at least one embodiment:

To use the apparatus 1 or 100, the user simply fits a lighter into receptacle designated for the lighter. The person has the option of using the lighter for purposes which it is intended for, or when the rolled cigarette is too low, and/or the user does not wish to hold the cigarette with his or her finger, they would slide up the alligator clip, open the clip and close the clip down onto the cigarette for hands-free smoking. This aspect limits the likelihood of fingers being burnt. When using a pipe, the metal poker 2 can be swiveled out to clean debris and residue which builds up and limits the efficiency of the pipe. Another feature is the rolled cigarette, when secured in the clip 6, can be lit with the lighter all while using one hand.

Additionally, the apparatus 1 or 100 can be used to light other items with the lighter, not only cigarettes.

Also, the apparatus 1 or 100 is configured to create: It can be used to light other items with the lighter, not only cigarettes.

In at least one embodiment, a multi-functional, all inclusive smoking tool or apparatus 1 or 100, which includes a lighter holder, pipe cleaner or poker 2 and retractable clip 6 or 106 is disclosed.

The alligator clip 6 or alligator clip 106, in at least one embodiment, cost about $0.30 each. The clip 6 or 106 may be a product from McMaster-Carr(trademarked). The wire 10 or 110 may cost about $0.08 each. The clip 6 or clip 106 may be glued by an epoxy to the wire 10 or 110, respectively, and the bearing 14 or corresponding bearing in apparatus 100. The epoxy may be as shown at https://www.mcmaster.com/#7236k52/=19nn90n.

The alligator clip 6 or 106 may be a micro jaw, banana jack/crimp/solder connection, having a jaw style of micro alligator, with a wire connection of banana jack, crimp, solder.

The alligator clip 6 or 106 material may be nickel-plated steel, which is noninsulated, with a jack connection size of 4 millimeters, and may be configured to be used with wire gauges of 18, 19, 20, 21, 22, 23, and 24.

The alligator clip 6 or 106 may have a rear connection compatibility with or of Banana Plug, Retractable Banana Plug, Sheathed Banana Plug.

The alligator clip 6 or 106 may have a jaw opening of 3/16 of an inch, a tooth style of toothed, be configured for a current of 5 Angstroms, have a length of one and one quarter inch, have a spring material of zinc-plated steel, a rivet material of zinc-plated steel, and have optional black viny or red vinyl sleeves.

The aluminum wire 10 or 110 may be a product from McMaster-Carr(trademarked) as shown at https://www.mcmaster.com/#8904k96/=19nna17.

The aluminum wire 10 or 110 may have a 0.081 diameter and may be lightweight. The aluminum wire 10 or 110 may be 1100 aluminum, round in cross section, solid in construction, matte in appearance, have a diameter tolerance of −0.002 inches to +0.002 inches, have a standard tolerance rating, have a tensile strength of 11,000 psi, be heat treated in fabrication, 0 temper, have a softened temper rating, not rated for hardness, have a soft hardness rating, not rated for minimum temperature, have a 200 degrees maximum temperature, meet ASTM B211, and be RoHS compliant.

The aluminum wire 10 or 110 may have 99% aluminum content. The 1100 type of aluminum is the most formable aluminium provided by one entity and is commonly used where strength and hardness are not required. The 1100 type of aluminum has a soft temper and will stay in place when bent. 1100 aluminum is non magnetic and not heat treatable.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a housing;

a cigarette lighter attached to the housing;

a poker attached to the housing so that the poker can swivel outward from the housing and swivel inward towards the housing, while attached to the housing; and wherein the elongated poker is configured to be swiveled outwards from the housing and thereafter used to clean debris from pipes, while attached to the housing;

further comprising a clip attached to the housing so that the clip is configured to be moved, while attached to the housing, from a first position to a second position, with respect to the housing;

wherein in the first position, the clip is at least partially within the housing, while attached to the housing; and wherein in the second position, the clip is entirely outside of the housing, while attached to the housing;

further comprising an actuation button attached to the housing so that the button is configured to be moved, while attached to the housing, from a third position to a fourth position, with respect to the housing; and wherein movement of the actuation button, from the third position to the fourth position causes movement of the clip from the first position to the second position, with respect to the housing.

2. The apparatus of claim 1 wherein the actuation button projects outwards from a side of the housing when the actuation button is in the third position and when the actuation button is in the fourth position; and wherein the clip projects outwards from a top of the housing when the clip is in the first position.

3. The apparatus of claim 1 wherein the clip is attached to a wire, which is attached to a bearing;

wherein the actuation button is attached to the bearing;

wherein when the actuation button moves, the bearing moves, the wire moves, and the clip moves, with respect to the housing;

wherein when the clip is in the first position with respect to the housing, the wire and the bearing are both entirely within the housing; and wherein when the clip is in the second position with respect to the housing, the wire is at least partially outside of the housing, and the bearing is entirely within the housing.

4. The apparatus of claim 1 wherein the housing includes a front housing and a rear housing; and wherein the front housing and the rear housing connect together to hold the poker.

5. The apparatus of claim 4 wherein a peg of the front housing goes through a looped end of the poker, and then the peg is locked into a hole of the rear housing in order to hold the poker in a manner which allows the poker to swivel with respect to the housing.

6. The apparatus of claim 1 wherein in the second position, the clip is configured to hold a cigarette so that the cigarette is lit by the cigarette lighter.

7. An apparatus comprising:

a housing;

a cigarette lighter attached to the housing;

a clip attached to the housing so that the clip is configured to be moved, while attached to the housing, from a first position to a second position, with respect to the housing;

wherein in the second position, the clip is configured to hold a cigarette so that the cigarette is lit by the cigarette lighter;

further comprising an actuation button attached to the housing so that the button is configured to be moved, while attached to the housing, from a third position to a fourth position, with respect to the housing;

wherein movement of the actuation button, from the third position to the fourth position causes movement of the clip from the first position to the second position, with respect to the housing;

and wherein the actuation button includes at least one protrusion configured to interact with a first plurality of grooves in the housing to hold the clip at the second position with respect to the housing against the force of gravity.

8. A method comprising the steps of:

swiveling a poker outward from a housing, while the poker is attached to the housing;

cleaning debris from one or more pipes, after the poker has been swiveled outwards from the housing, and while the poker is attached to the housing; and swiveling a poker inward toward a housing, while the poker is attached to the housing; and wherein a cigarette lighter is attached to the housing;

wherein a clip is attached to the housing so that the clip is configured to be moved, while attached to the housing, from a first position to a second position, with respect to the housing;

wherein in the first position, the clip is at least partially within the housing, while attached to the housing;

wherein in the second position, the clip is entirely outside of the housing, while attached to the housing;

wherein an actuation button is attached to the housing so that the button is configured to be moved, while attached to the housing, from a third position to a fourth position, with respect to the housing; and wherein movement of the actuation button, from the third position to the fourth position causes movement of the clip from the first position to the second position, with respect to the housing.

9. The method of claim 8 wherein the actuation button projects outwards from a side of the housing when the actuation button is in the third position and when the actuation button is in the fourth position; and wherein the clip projects outwards from a top of the housing when the clip is in the first position.

10. The method of claim 8 wherein the clip is attached to a wire, which is attached to a bearing;

wherein the actuation button is attached to the bearing;

wherein when the actuation button moves, the bearing moves, the wire moves, and the clip moves, with respect to the housing;

wherein when the clip is in the first position with respect to the housing, the wire and the bearing are both entirely within the housing; and wherein when the clip is in the second position with respect to the housing, the wire is at least partially outside of the housing, and the bearing is entirely within the housing.

11. The method of claim 8 wherein the housing includes a front housing and a rear housing; and wherein the front housing and the rear housing connect together to hold the poker.

12. The method of claim 11 wherein a peg of the front housing goes through a looped end of the poker, and then the peg is locked into a hole of the rear housing in order to hold the poker in a manner which allows the poker to swivel with respect to the housing.

13. The method of claim 8 wherein in the second position, the clip is configured to hold a cigarette so that the cigarette is lit by the cigarette lighter.

14. The method of claim 8 further comprising:

moving the clip from the first position to the second position, while the clip is attached to the housing;

wherein in the second position, the clip is configured to hold a cigarette so that the cigarette is configured to be lit by the cigarette lighter; and lighting the cigarette with the cigarette lighter, while the cigarette is being held by the clip, and while the clip is attached to the housing.

15. A method comprising the steps of:

swiveling a poker outward from a housing, while the poker is attached to the housing;

cleaning debris from one or more pipes, after the poker has been swiveled outwards from the housing, and while the poker is attached to the housing; and swiveling a poker inward toward a housing, while the poker is attached to the housing; and wherein a cigarette lighter is attached to the housing;

further comprising:

moving a clip from a first position to a second position, while the clip is attached to the housing;

wherein in the second position, the clip is configured to hold a cigarette so that the cigarette is configured to be lit by the cigarette lighter; and lighting the cigarette with the cigarette lighter, while the cigarette is being held by the clip, and while the clip is attached to the housing;

wherein an actuation button is attached to the housing so that the actuation button is configured to be moved, while attached to the housing, from a third position to a fourth position, with respect to the housing;

wherein movement of the actuation button, from the third position to the fourth position causes movement of the clip from the first position to the second position, with respect to the housing;

and wherein the actuation button includes at least one protrusion configured to interact with a first plurality of grooves in the housing to hold the clip at the second position with respect to the housing against the force of gravity.

* * * * *